US008344913B2

(12) United States Patent
Rieth et al.

(10) Patent No.: US 8,344,913 B2
(45) Date of Patent: Jan. 1, 2013

(54) TRANSMISSION OF AN EMERGENCY CALL COMPRISING ADDRESS DATA

(75) Inventors: Peter Rieth, Eltville (DE); Ulrich Stählin, Eschborn (DE)

(73) Assignee: Continental Teves AG & Co. oHG (DE)

( * ) Notice: Subject to any disclaimer, the term of this patent is extended or adjusted under 35 U.S.C. 154(b) by 537 days.

(21) Appl. No.: 12/593,481

(22) PCT Filed: Mar. 27, 2008

(86) PCT No.: PCT/EP2008/053650

§ 371 (c)(1),
(2), (4) Date: Sep. 28, 2009

(87) PCT Pub. No.: WO2008/119736

PCT Pub. Date: Oct. 9, 2008

(65) Prior Publication Data

US 2010/0117869 A1 May 13, 2010

(30) Foreign Application Priority Data

Mar. 29, 2007 (DE) ..... 10 2007 015 562
Mar. 27, 2008 (DE) ..... 10 2008 016 227

(51) Int. Cl.
*G08G 1/123* (2006.01)

(52) U.S. Cl. ..... 340/989

(58) Field of Classification Search ..... 340/989, 340/901, 938, 539.13, 539.2, 7.5; 455/404.1
See application file for complete search history.

(56) References Cited

U.S. PATENT DOCUMENTS

| | | | | |
|---|---|---|---|---|
| 6,339,370 | B1 * | 1/2002 | Ruhl et al. | 340/436 |
| 6,573,831 | B2 | 6/2003 | Ikeda et al. | |
| 6,617,979 | B2 | 9/2003 | Yoshioka | |
| 6,618,657 | B1 | 9/2003 | Geil et al. | |
| 6,646,604 | B2 * | 11/2003 | Anderson | 342/465 |
| 6,838,998 | B1 * | 1/2005 | Brown et al. | 340/539.2 |
| 7,076,236 | B2 | 7/2006 | Ihira et al. | |
| 7,580,697 | B2 | 8/2009 | Lappe et al. | |
| 2003/0016147 | A1 | 1/2003 | Evans | |
| 2004/0024522 | A1 * | 2/2004 | Walker et al. | 701/210 |
| 2005/0071237 | A1 * | 3/2005 | Caspi et al. | 705/25 |
| 2007/0032220 | A1 * | 2/2007 | Feher | 455/404.1 |
| 2007/0142026 | A1 * | 6/2007 | Kuz et al. | 455/404.1 |
| 2007/0206738 | A1 * | 9/2007 | Patel et al. | 379/93.24 |

FOREIGN PATENT DOCUMENTS

| | | | |
|---|---|---|---|
| DE | 43 21 416 | A1 | 1/1995 |
| DE | 299 11 590 | U1 | 1/2000 |
| DE | 198 49 846 | A1 | 6/2000 |
| DE | 199 17 207 | C2 | 10/2000 |
| DE | 199 22 730 | A1 | 11/2000 |
| DE | 101 37 670 | A1 | 4/2002 |
| EP | 1 280 120 | A1 | 1/2003 |
| EP | 1 372 324 | A2 | 12/2003 |
| JP | 2004-227187 | | 8/2004 |
| WO | WO 03/042943 | A2 | 5/2003 |

* cited by examiner

*Primary Examiner* — Phung Nguyen
(74) *Attorney, Agent, or Firm* — RatnerPrestia

(57) ABSTRACT

An automatic emergency call is transmitted in the form of voice data which contain address information for the vehicle. The address information has been ascertained inside the vehicle by the emergency call device on the basis of a GPS position.

17 Claims, 2 Drawing Sheets

TRANSMISSION OF AN EMERGENCY CALL COMPRISING ADDRESS DATA

CROSS REFERENCE TO RELATED APPLICATIONS

This application is the U.S. national phase application of PCT International Application No. PCT/EP2008/053650, filed Mar. 27, 2008, which claims priority to German Patent Application No. DE 10 2007 015 562.1, filed Mar. 29, 2007 and German Patent Application No. DE 10 2008 016 227.2, filed Mar. 27, 2008, the contents of such applications being incorporated herein by reference.

1. FIELD OF THE INVENTION

The invention relates to emergency and safety engineering for vehicles. In particular, the invention relates to an emergency call device for a vehicle for the transmission of an emergency call, to an emergency call system, to the use of an emergency call device in a vehicle, to a method, to a computer program product and to a computer-readable medium.

2. DESCRIPTION OF THE RELATED ART

Vehicle emergency radio systems have been known for a long time. By way of example, DE 43 21 416 A1 discloses a vehicle emergency radio system which is based on the vehicle emergency radio system in the demonstrations project ARTHUR from 1989. To allow the position of the vehicle which has had an accident to be found regardless of the radio-related constraints, for example radio-related shadow effects in tunnels, at the location of the accident, provision is made a) for the position-finding device to automatically ascertain the present position of the vehicle during the (entire) operating phase of the vehicle continuously, preferably at prescribed intervals of time, and to transfer the ascertained position data to the emergency transmitter, and b) for the position data to remain stored in the emergency transmitter until new position data are received from the position-finding device.

In the event of an accident, the crash sensor (e.g. the airbag sensor) connected to a control unit (which is connected to a position-finding device and to an emergency transmitter, e.g. in the form of an appropriately modified car telephone) uses prescribed accident criteria to check whether or not an emergency signal needs to be sent. If the criteria are met, the crash sensor uses the control unit to send an enable signal to the emergency transmitter, which then uses the second antenna to send an emergency signal by radio together with the currently stored position data for the vehicle 1. In addition, it is possible for the crash sensor, upon the accident criteria being met, to prompt fresh determination of the vehicle position by the position-finding device and for these position data to be sent by the emergency transmitter together with the emergency signal. In addition, it is possible to use a travel pilot for position finding instead of a GPS device (Global Positioning System).

An emergency reporting apparatus which can recognize a plurality of signal formats, so that it can be installed generally in vehicles or models with different signal formats for the signals from an airbag device, is known from DE 101 37 670 A1. In this case, the airbag device is connected to a control unit and is activated by means of a LAN signal line, when a vehicle LAN bus line is used, or by means of a direct line which is not a LAN signal line when a vehicle without a vehicle LAN is involved. The airbag device outputs a status signal in order to identify whether a LAN connection or a direct line connection is involved. In this case, the control unit provides the following functions:

1) An emergency call request is recognized from an operation signal from an emergency reporting key, an airbag deployment signal which is output by the airbag device in the event of a collision or accident, or an automatic emergency reporting signal on the basis of a fuel interruption signal.

2) The emergency reporting process is started by reading position information and other data from a memory unit.

3) The telephone number stored in the memory unit for the control center, such as for the police or for a rescue center which monitors the emergency reporting system, is read.

4) A telephone call is requested from the emergency reporting unit using this telephone number.

5) The transition to the conversation state is recognized when a response signal from the party corresponding to the telephone number or a signal which changes to the conversation state, such as a call connected signal, is received.

6) Position information and course data, which have been obtained from the position information capture/processing unit, and also the control center call signal are sent to the emergency reporting unit via the base station of the communication device.

In addition, DE 299 11 590 U1 discloses an apparatus which is permanently installed in a car and triggers from the airbag and sensors. The apparatus comprises a digital hands-free telephone—programmed only for emergency calls—in a housing which, by virtue of its design, is suitable for installation in the internal lining of the car roof, and control lines to the external on/off switches, for example airbag or sensors. The emergency call is made automatically when one of the airbags or sensors in the car is triggered or the emergency call is triggered manually by means of a pushbutton switch or by further sensors installed in the vehicle. Preferably, the apparatus is accommodated centrally between the front and rear seats under the roof of the car.

A further emergency call device for vehicles which sends an emergency message to a rescue control center in the event of an accident ascertained by sensors in the vehicle, wherein the emergency message contains suitable information for the initiation of assistance measures, is known from DE 199 17 207 C2. To ensure that an emergency message is sent to a rescue control center even if the onboard electronics of the vehicle are destroyed by the accident, provision is made for the emergency call device to send a first message containing at least the geographical vehicle position in a critical driving situation ascertained by the sensors before an accident has actually occurred. If the critical driving situation subsequently does not result in an accident, the rescue control center is informed of the first message having lapsed by means of a second message, which is sent after a prescribed period of time has elapsed after the first message. The sensors can capture translational accelerations and/or angle-of-rotation accelerations by the vehicle and/or changes in the shape of the vehicle bodywork and/or braking processes and/or steering movements. An evaluation unit takes the sensor signals and uses threshold value decisions to infer whether a critical driving situation is present and whether an accident has arisen from a critical driving situation. The second message then contains information about the vehicle registration and/or the vehicle type and/or the severity of the accident and/or the number of vehicle occupants and/or acute illnesses in the vehicle occupants. After the second message, at least one further message can also be sent which contains further information about the course of events in the accident and/or the situation of the affected vehicle occupants.

A similar emergency call system with a transmitter/mobile telephone provided in the motor vehicle for the automatic transmission of an emergency call to an external receiving station and with at least one signal generator, wherein the transmitter and the signal generator are connected to a computation unit which activates the emergency call if there is an appropriate signal from the signal generator, is known from DE 199 22 730 A1. The emergency call system contains means for determining a degree of probability of an imminent accident with the signals from the signal generator, and the emergency call (together with the position ascertained by means of GPS navigation or compound navigation or by beacons at the edge of the road) can be activated when a limit value for the degree of probability is exceeded. In particular, the emergency call system contains, as a signal generator, measuring means connected to the computation unit for determining the relative speed and the distance of the vehicle from another vehicle or from an obstacle (radar system, infrared system), the computation unit being able to perform a comparison between the relative speed determined by means of the radar system and a maximum admissible value for the relative speed at the measured distance. The emergency call can therefore actually be activated before the accident if the maximum admissible relative speeds at a given distance are exceeded. However, it is also possible to store a plurality of pairs of values for a distance and for an associated maximum admissible relative speed in a memory and to determine the maximum admissible relative speed, including on the basis of the state of the road (optical sensors), by means of interpolation for example. In order to prevent false alarms, the computation unit is connected to at least one sensor for detecting an accident, particularly to an acceleration sensor on the airbag or to a temperature sensor (vehicle fire). The emergency call system also contains a timer which is connected to the computation unit and which is started when the emergency call is activated. If there is no signal signaling a collision from the sensor at the time at which the timer expires, the emergency call is automatically cancelled by means of the mobile telephone or the transmitter.

So as still to be able to safely send an emergency call using a radio telephone even in the event of a severe impact or collision of a vehicle, it is known practice from WO 03/042943 A2 to arrange an autarkic emergency call unit at a location in the vehicle which is particularly protected against damage through collision or impact. To this end, the emergency call unit is equipped with a dedicated battery, with a GSM transceiver and with a transmission and reception unit for setting up a short radio link to the radio telephone, and when an emergency call is triggered, the emergency call unit sends an emergency call via the short radio link to the radio telephone, which forwards the emergency call to an emergency control center by radio. Since the emergency call unit is not connected to the radio telephone by cable—electrical or optical fibers—but rather by means of a radio link, it is not possible for the situation to arise in which a collision causes the cables to be destroyed and the sending of an emergency call therefore to be rendered impossible. The radio transmission of an emergency call from the emergency call unit to the radio telephone is effected on the basis of the Bluetooth standard. An emergency call can be triggered by the trigger signal from an airbag, for example, as in the case of known emergency call devices. In addition, the emergency call unit may contain a sensor which detects a collision and immediately prompts the sending of an emergency call.

By way of example, the sensor provided may be a gyroscope which prompts the triggering of an emergency call from the emergency call device to the radio telephone not by means of electrical signals but rather in mechanical fashion. Since the gyroscope reacts right at the start of a collision, an emergency call is actually sent before the radio telephone is damaged or destroyed. The short time between the detection of a collision by the gyroscope and possible damage or destruction of the radio telephone by an impact suffices to allow the Bluetooth link to be used still to transmit all data which are relevant to the accident. If this time is no longer sufficient for sending an emergency call, the GSM transceiver in the emergency call device sends an emergency call. Another option is for a commercially available radio telephone to be prepared to receive the emergency calls sent by the emergency call unit and to forward them to an emergency control center or for the user to use the mobile telephone to activate the emergency call unit and to trigger an emergency call. In this case, the mobile telephone acts more or less as a remote control for the emergency call unit.

In addition, portable emergency transmitters which can be activated by the user by pressing a key have been known for a long time. To send an emergency call within a few seconds without pressing keys using a portable mobile telephone or an emergency transmitter incorporated in a wristwatch, brooch or bracelet, it is known from DE 198 49 846 A1 that said mobile telephone/emergency transmitter has a voice recognition program, that at least one emergency telephone number is permanently stored and that input/recognition of a particular word prompts the emergency telephone number to be dialed automatically. In addition, the mobile telephone/emergency transmitter may be equipped with a pulse generator for finding the current position.

A mobile telephone/emergency transmitter which is known from EP 1 372 324 A2 is designed in a similar manner. In one embodiment described therein, various previously stored keywords are evaluated—in silent alarm mode—and recognition of one of the keywords prompts an emergency message to be sent to a rescue control center/police station via the mobile radio network.

Finally, U.S. Pat. No. 6,573,831 B2 discloses a monitoring apparatus in the vehicle in which a microphone is used to continuously pick up and store sounds in the area of the vehicle so as to be able to evaluate them after any accident which has occurred. The sounds captured by means of the microphone are themselves not used to trigger an emergency call in the vehicle, however.

As shown by the above acknowledgement of the prior art, differently designed vehicle emergency radio systems with or without position-finding or determination of a degree of probability of an imminent accident are known. Usually, it is necessary for the mobile telephone to be integrated into the vehicle electronics or to be coupled thereto by means of interfaces, or two radio telephones are necessary, as in the case of the subject matter of WO 03/042943 A2.

In addition, extensive precautions need to be taken with regard to unintentional trigger processes for an emergency call. Triggering using stored keywords on a mobile telephone/emergency transmitter carried by the user also fails if the road user is himself unable to do this after an accident. Therefore, what is missing in practice is a vehicle emergency radio system which can be used universally regardless of other technical circumstances and which triggers an emergency call automatically in the event of an accident.

In the European Union's 112-eCalls, the transmission of the GPS position when an emergency call is sent is mandatory even if only the smallest possible data record is intended to be transmitted.

In the case of an automated emergency call, both data and voice are transmitted. By way of example, the data comprise the time of the accident, the position and direction of the accident, the severity of the accident, etc. These data are modulated onto the voice and then data and voice are separated again at the receiving station. Another option is to send the data via SMS.

Both processes assume that both the transmitter and the receiver are in control of the same decoding technology.

In the case of an automated emergency call (eCall), the GPS position is transmitted. Using this position, the emergency control center (Public Safety Answering Point, PSAP) can ascertain from where the emergency call was sent. However, this requires the PSAP to be able to interpret the position data, i.e. the position data need to be transmitted in a format and an encoding which the PSAP is also able to decode. In addition, the PSAP requires a piece of software which can ascertain an address from the GPS position.

SUMMARY OF THE INVENTION

It is an object of the invention to provide an improved emergency call for vehicles.

The invention specifies an emergency call device for a vehicle for transmitting an emergency call, an emergency call system, a use, a method, a computer program product and a computer-readable medium.

The exemplary embodiments described relate equally to the emergency call device, the emergency call system, the use, the method, the computer program product and the computer-readable medium.

In line with one exemplary embodiment of the invention, an emergency call device for a vehicle for transmitting an emergency call is specified which has a detection unit, a control unit and a communication unit. The detection unit is used to capture a position for the vehicle and the control unit is used to ascertain address data for the vehicle on the basis of a digital map and the captured position of the vehicle. In addition, the control unit is designed to convert the address data by means of a media conversion. The communication unit is used to transmit the emergency call to a receiver, said emergency call containing the converted data.

The term media conversion denotes quite generally, the translation, transformation or conversion of a file from one file format into another. This applies to the transfer of data between different media and file systems in the same way as to the transmission of data from one storage medium to another.

When an emergency call is thus intended to be sent, the control unit can resort to the detection unit and obtain information about the current vehicle position from the detection unit. To this end, the detection unit has a GPS receiver.

At this juncture, it should be pointed out that within the context of the present invention GPS is representative of all the global navigation satellite systems (GMSS), such as GPS, Galileo, GLONASS (Russia), Compass (China), IRNSS (India).

When the control unit has the GPS position available, this text information is compared with the digital map and in this way the address of the accident location (road and house number or another form of address characterization) is ascertained. This address information is then converted by the control unit and transformed into a piece of voice information, for example, which is then subsequently transmitted from the communication unit to one or more receivers.

This allows the complexity for reading the received data to be reduced, since firstly the receivers already have a (postal) address available, and secondly a multiplicity of different receiving appliances can be used which merely need to be able to produce the converted data.

By way of example, it is thus possible for all the information to be transmitted just via one voice link, which means that the receivers have no need for decoding.

The term "digital maps" is also intended to be understood to mean maps for advanced driver assistance systems (ADASs), without any navigation taking place.

By way of example, the vehicle is a motor vehicle, such as a car, bus or heavy goods vehicle, or else a rail vehicle, a ship, an aircraft, such as a helicopter or airplane, or a bicycle, for example.

In line with a further exemplary embodiment of the invention, the detection unit is designed to capture further measured values and the control unit is designed to evaluate the measured values. The control unit can take this evaluation as a basis for deciding whether an accident or another situation has occurred which is meant to result in an automated emergency call being triggered. The transformed data, that is to say the emergency call, are transmitted only if the evaluation indicates such a situation, for example an accident that has occurred.

In this way, the triggering of the emergency call can be fully automated. User intervention is not required. The emergency call is thus sent even if the driver is no longer able to act.

In line with a further exemplary embodiment of the invention, the emergency call additionally contains the position of the vehicle, for example in the form of GPS data. This position statement is likewise transformed into voice information prior to transmission and is then transmitted to the receivers serially with the address data.

The GPS position and the address data are transmitted serially in the same transmission channel, for example.

In line with a further exemplary embodiment of the invention, the control unit has, for the purpose of converting the data into a piece of voice information, a voice synthesizer which is designed to convert data by means of voice synthesis.

In line with a further exemplary embodiment of the invention, the communication unit and the control unit are designed to selectively transmit the data in text form or as already media-converted data in response to a request from the receiver.

The receiver is thus able to decide whether it wishes to have the data transmitted as audio data or video data or in text form, e.g. as SMS. It is also possible for the receiver to select that the GPS position needs to be transmitted in text form but the address information needs to be transmitted as voice.

In line with a further exemplary embodiment of the invention, the receiver is a mobile terminal. Its number may be permanently stored in the communication unit, for example, or can be ascertained from a directory service. The automated emergency call can thus be received by a multiplicity of mobile receivers which then possibly forward the emergency call to other mobile receivers or to a control center.

In line with a further exemplary embodiment of the invention, the receiver is a permanently installed NAD (Network Access Device).

In line with a further exemplary embodiment of the invention, the communication link for transmitting the voice information is a narrowband communication link. In this way, it is also possible to use inexpensive, narrowband receiving appliances.

In line with a further exemplary embodiment of the invention, the emergency call contains further voice information which corresponds to an audible voice input from a vehicle occupant, wherein the communication unit is designed to transmit all the data in the same transmission channel.

It is thus possible for the vehicle occupants also to send voice messages which are then transmitted by the emergency call device. All the information is transmitted serially in the same transmission channel.

In line with a further exemplary embodiment of the invention, the emergency call device is designed to send a fully automatic emergency call.

In line with a further exemplary embodiment of the invention, an emergency call system is specified which has an emergency call device as described above and a receiver for receiving the voice information.

In line with a further exemplary embodiment of the invention, the receiver is designed to automatically make a return call when an emergency call is received if no further message from the occupant of the vehicle is received within a prescribed period of time, wherein the receiver then initiates appropriate rescue measures, the emergency call unit being designed such that it can be called back and can accept this return call.

In this way, a fully automatic emergency call system is provided.

In line with a further exemplary embodiment of the invention, the use of an emergency call device as described above in a vehicle is specified.

In line with a further exemplary embodiment of the invention, a method for the transmission of an emergency call from a vehicle to one or more receivers is specified in which a position for the vehicle is captured, address data for the vehicle are ascertained on the basis of a digital map and the captured position, the address data are converted by means of a media conversion and an emergency call is transmitted to a receiver, said emergency call containing the converted data.

In line with a further exemplary embodiment of the invention, the method also comprises the use of the distance covered in the past and of other vehicle variables for ascertaining the address data.

In this way, the address can be determined with increased accuracy.

In line with a further exemplary embodiment of the invention, a computer program product is specified which, when executed on a processor, prompts the processor to perform the method steps described above.

In line with a further exemplary embodiment of the invention, a computer-readable medium is specified which stores a computer program product which, when executed on a processor, prompts the processor to perform the method steps specified above.

A fundamental consideration of the invention can be seen as being that an automated emergency call is accompanied by the transmission of the address at which the emergency call was sent. In this case, the address is ascertained from the digital map and the address is transmitted by means of text-to-speech. This makes it possible to simplify the initiation of rescue measures, since firstly the vehicle position can be established by the rescuers more easily and secondly there are many more potential receivers available, since the technical demands on the individual receiving appliances are reduced.

BRIEF DESCRIPTION OF THE DRAWINGS

The text below describes preferred exemplary embodiments of the invention with reference to the figures.

The illustrations in the figures are schematic and not to scale.

DETAILED DESCRIPTION OF THE PREFERRED EMBODIMENTS

In the description of the figures which follows, the same reference symbols are used for the same or similar elements.

Figure 1:
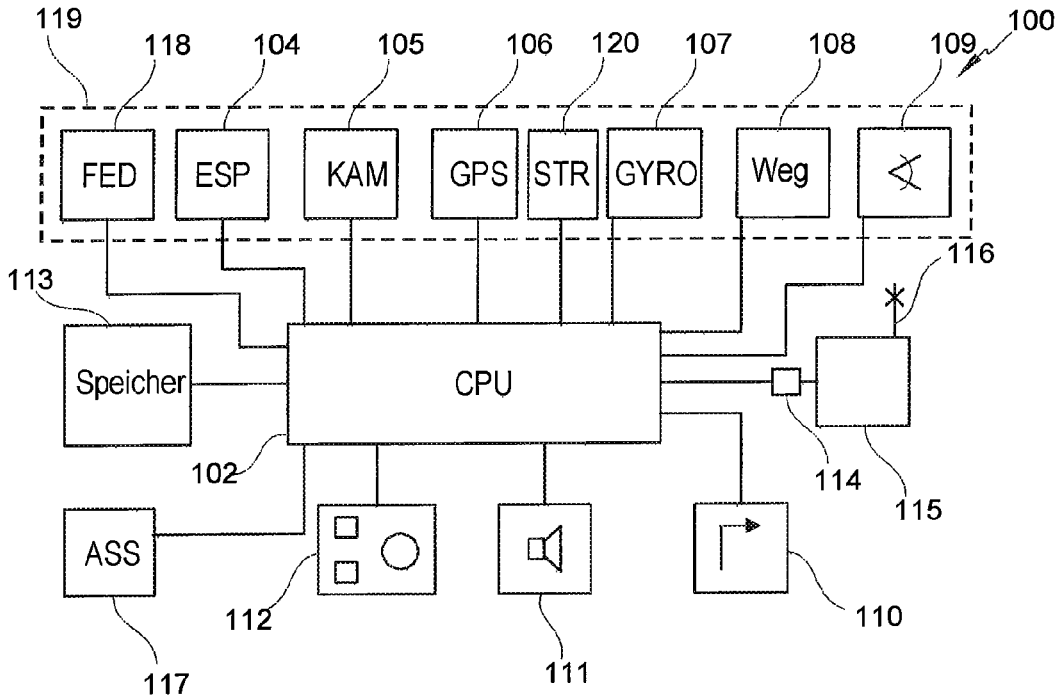
FIG. 1 shows a schematic illustration of an emergency call device based on an exemplary embodiment of the invention.

FIG. 1 shows a schematic illustration of components of an emergency call device 100. The emergency call device 100 is installed in a vehicle, for example, and is used to transmit an automated emergency call to a rescue control center or else to individual mobile receivers.

The emergency call device 100 has a detection unit 119, a control unit 102 and a communication unit 115 with an antenna 116.

The data to be sent, which are transmitted to the communication unit 115 by the control unit 102, which is in the form of a CPU, for example, can be encrypted using an encryption device 114. Similarly, the received data which are transmitted to the control unit 102 by the communication unit 115 can be decrypted by the encryption unit 114.

In this way, it is possible to reduce the risk of misuse.

The control unit 102 has an input unit 112 connected to it. For the input unit 112, it is possible to make various settings on the emergency call device and a navigation unit associated therewith. The navigation unit is an optional part of the emergency call device.

In addition, an optical output unit in the form of a monitor 110 is provided on which it is possible to output routing information, for example. Furthermore, the routing information can also be output by means of an audible output unit 111. The output by means of the audible output unit 111 has the advantage that the driver is less distracted from the current traffic situation.

A memory element 113 which is connected to the control unit 102 or is integrated in the control unit 102 stores the digital map data (e.g. as navigation map data) in the form of data records. By way of example, the memory element 113 also stores additional information about traffic limitations and the like in association with the data records.

In addition, a driver assistance system 117 is provided which is supplied with the digital map data.

For the purpose of determining the current vehicle position, the emergency call device 100 has a navigation unit with a satellite navigation receiver 106, which is designed to receive navigation signals from Galileo satellites or GPS satellites, for example. Naturally, the navigation unit with the satellite navigation receiver 106 may also be designed for other satellite navigation systems.

Since the navigation signals cannot always be received, for example in inner cities, the emergency call device also has, for the purpose of performing compound navigation, a direction sensor 107, a distance sensor 108, a steering-wheel angle sensor 109 and possibly also a spring travel sensor 118 and also an ESP sensor system 104 and possibly an optical detector 105, such as a camera, or a beam sensor 120, such as a radar.

The signals from the GPS receiver and the other sensors are processed in the control unit 102. The vehicle position ascertained from these signals is aligned with the road maps by means of map matching. The routing information obtained in this manner is finally output via the monitor 110.

All data provided for the transmission of the emergency call are transformed into voice information by the control unit 102, which has a voice synthesizer, by means of voice synthesis and are then transmitted via an appropriate (voice) communication channel.

Figure 2:
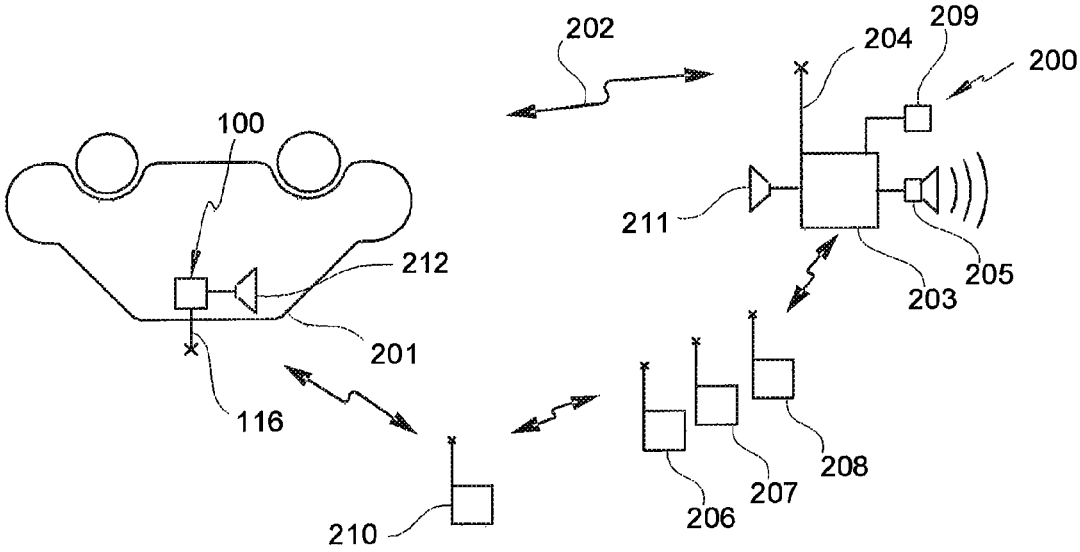
FIG. 2 shows a schematic illustration of an emergency call system based on an exemplary embodiment of the invention.

FIG. 2 shows a schematic illustration of an emergency call system which has an accident vehicle 201 with an emergency call device 100 and also a control center 200.

The control center 200 comprises a communication unit 203 in the form of a central server and an antenna 204 for sending and receiving the data and information using the radio transmission link 202.

In addition, a loudspeaker 205 is provided which can be used to play back the received voice information. For the purpose of playing back video files, a monitor 209 is provided. In addition, the server 203 has a microphone 211 and the emergency call device 100 has a further microphone 212.

The control center 200 is a rescue control center which is able to perform the rescue control fully automatically.

By way of example, the control center 200, having received the automated emergency call, transmits instructions to individual receivers 206, 207, 208. In addition, the emergency call can also be transmitted directly to an individual receiver 209, which then forwards this emergency call to the individual receivers 206, 207, 208 and/or to the control center 200. In this way, the emergency call can also be effectively distributed to a multiplicity of receivers in areas in which reception is short range.

In line with the invention, an electronic emergency call (eCall) can be transmitted which the rescue personnel can understand directly. This requires a digital map in the vehicle which can be used to ascertain from the GPS position the road, including the house number, on which the emergency call is being sent. This address is transmitted instead of or in combination with the GPS position.

To this end, the data to be transmitted are transformed into voice (text-to-speech) by a synthesizer and are then transmitted to the receivers via a voice channel. During the data transmission, the voice from the vehicle is buffer-stored in the buffer (in a similar manner to time-delayed television (Timeshift), as is used in video recorders) so as not to lose any information.

It is thus also possible for PSAPs to use this information which otherwise have no means of receiving data or do not know the encoding used in the vehicle. In other words, "old" PSAPs which have only a voice link can also use the data. Data reception today requires specific hardware and software which is not yet standardized and hence still needs to be integrated into all PSAPs (at appropriately high cost).

A further advantage involves the distance covered in the past and additional vehicle variables (steering-wheel angle, wheel speed, . . . ) being able to be incorporated into the ascertainment of position. This is particularly useful in the case of poor GPS reception, for example in urban canyons, tunnels or in buildings, or in the case of difficult regional circumstances (many roads, close together, roads above one another, . . . ).

According to one aspect of the invention, it is no longer necessary for the PSAP to translate the position information into an address. This activity is actually performed in the vehicle and hence the address information is also present when the PSAP does not have this technology available. The conversion of the text-to-speech can be used to provide the address even when there is no data reception possible on the part of the PSAP. Use of the distance covered in the past and of other vehicle variables also allows the address to be ascertained more precisely.

The pure use of voice or (moving) images as a transmission medium means that no standardization of the data interface is necessary and also no change in the infrastructure. In this regard, the data are converted into voice by means of text-to-speech or another media conversion, and data which represent the normal voice of the vehicle occupants are buffered during the transmission.

Figure 3:
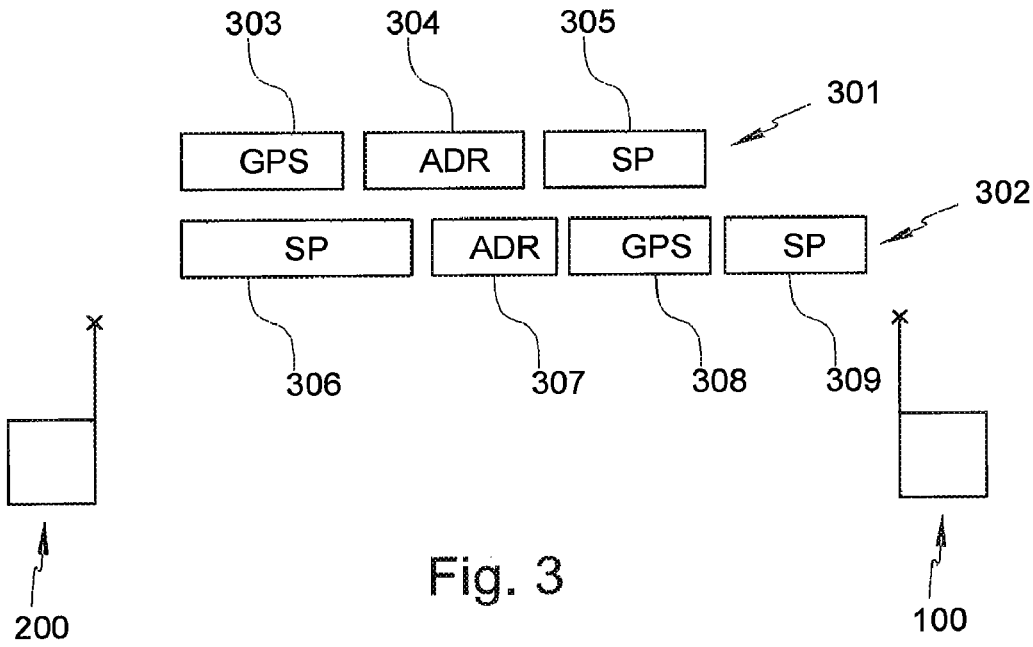
FIG. 3 shows a schematic illustration of a data transmission sequence based on an exemplary embodiment of the invention.

FIG. 3 shows a schematic illustration of two transmission sequences 301, 302 which symbolize two automatic emergency calls which are transmitted from the transmitter 100 to the receiver 200.

In a first sequence 301, a GPS signal 303 is transmitted first of all. This is followed by the transmission of the address data 304, followed by transmission of spoken information 305.

All the data are transmitted serially in the same data channel.

The second emergency call 302 involves spoken data 306 being transmitted first. After a break in speech, the address data 307 are transmitted, followed by transmission of the GPS position 308. Words from the vehicle occupants 309 are then transmitted again. Since the occupants have started to speak again in the meantime, this voice information 309 has been buffer-stored so as not to suffer any loss of data.

Figure 4:
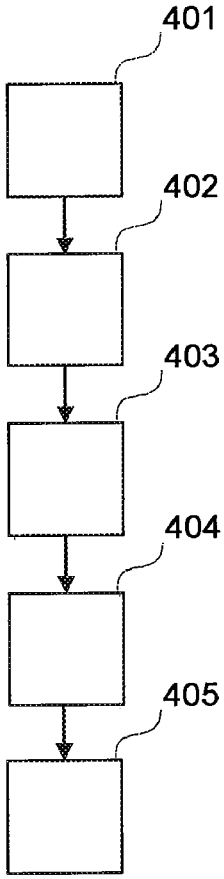
FIG. 4 shows a flowchart for a method based on an exemplary embodiment of the invention.

FIG. 4 shows a flowchart for a method in which the accident is captured by the vehicle sensor system in step 401. In step 402, the accident location is captured by means of GPS navigation technology. To make the measurement of the accident location even more precise, this involves the use of further measurement data captured by the vehicle sensor system, such as ESP data.

In step 403, the address data from the vehicle are determined on the basis of the ascertained position and digital map data.

In step 404, the ascertained address data are converted into voice information by means of a voice synthesizer, and in step 404 the synthesized address data are sent to a receiving station as an automatic emergency call.

It should additionally be pointed out that "comprising" and "having" do not exclude other elements or steps and "a" or "an" does not exclude a multiplicity. Furthermore, it should be pointed out that features or steps which have been described with reference to one of the above exemplary embodiments can also be used in combination with other features or steps in other exemplary embodiments described above.

The invention claimed is:

1. An emergency call device for a vehicle for the transmission of an emergency call, said emergency call device having:

a detection unit;

a control unit;

a communication unit;

wherein the detection unit is configured to capture a position of the vehicle;

wherein the control unit is configured to ascertain address data for the vehicle on a basis of a digital map and a captured position of the vehicle;

wherein the control unit is configured to convert the address data into a voice signal by text-to-speech conversion;

wherein the communication unit is configured to transmit an emergency call over a voice channel to a receiver, the emergency call containing the voice signal.

2. The emergency call device as claimed in claim 1,
wherein the detection unit is configured to capture further measured values;
wherein the control unit is configured to evaluate the measured values;
wherein the control unit takes the evaluation as a basis for deciding whether an accident has occurred;
wherein the converted data are transmitted only if the evaluation indicates that an accident has occurred.

3. The emergency call device as claimed in claim 1,
wherein the control unit has, for the purpose of converting the address data into a piece of voice information, a voice synthesizer which is configured to convert data by voice synthesis.

4. The emergency call device as claimed in claim 1,
wherein the communication unit and the control unit are configured to selectively transmit the data in text form or to transmit the data as converted, media-converted data in response to a request from the receiver.

5. The emergency call device as claimed in claim 1,
wherein the receiver is a mobile terminal.

6. The emergency call device as claimed in claim 1,
wherein the receiver is a permanently installed network access appliance.

7. The emergency call device as claimed in claim 1,
wherein a communication link for transmitting the converted data is a narrowband communication link.

8. The emergency call device as claimed in claim 1,
wherein the emergency call contains further information which corresponds to an audible voice input from a vehicle occupant;
wherein the communication unit is configured to transmit all the data in the same transmission channel.

9. The emergency call device as claimed in claim 1, configured for the purpose of fully automatic transmission of the emergency call.

10. The emergency call device as claimed in claim 1,
wherein the emergency call also contains the captured position of the vehicle.

11. The emergency call device as claimed in claim 1,
wherein the converted data have at least one data type, selected from the group consisting of text data, video data and audio data.

12. An emergency call system having:
an emergency call device as claimed in claim 1; and
a receiver for receiving and reproducing the converted data.

13. The emergency call system as claimed in claim 12,
wherein the receiver is configured to automatically make a return call when receiving an emergency call if no further message from the occupant of the vehicle is received within a prescribed period of time, wherein the receiver then initiates appropriate rescue measures;
wherein the emergency call unit is configured to be called back and can accept the return call.

14. The use of an emergency call device as claimed in claim 1 in a vehicle.

15. A method for the transmission of an emergency call from a vehicle, said method having the following steps:
capturing a position of the vehicle;
ascertaining address data for the vehicle on the basis of a digital map and the captured position;
converting the address data into a voice signal by text-to-speech conversion;
transmitting an emergency call over a voice channel to a receiver, the emergency call containing the voice signal.

16. The method as claimed in claim 15, wherein the ascertaining step further comprises ascertaining the distance covered in the past and other vehicle variables.

17. A non-transitory computer-readable medium which stores a computer program product which, when executed, instructs a processor to perform the following steps:
capture a position of a vehicle;
ascertain address data for the vehicle on the basis of a digital map and the captured position;
convert the address data into a voice signal by text-to-speech conversion;
transmit an emergency call over a voice channel to a receiver, the emergency call containing the voice signal.

* * * * *